United States Patent [19]

Libow

[11] Patent Number: 4,525,983

[45] Date of Patent: Jul. 2, 1985

[54] WRAPPING AND SEALING APPARATUS

[76] Inventor: Mitchell Libow, 1952 Coldwater Canyon, Beverly Hills, Calif. 90210

[21] Appl. No.: 433,794

[22] Filed: Oct. 12, 1982

[51] Int. Cl.[3] ..... B65B 11/06; B65B 51/10

[52] U.S. Cl. ..... 53/463; 53/464; 53/221; 53/227

[58] Field of Search ..... 53/463, 464, 221, 226, 53/227

[56] References Cited

U.S. PATENT DOCUMENTS

| | | | |
|---|---|---|---|
| 429,759 | 6/1890 | Hiatt | 53/227 |
| 516,638 | 3/1894 | Nininger | 53/227 |
| 1,703,641 | 2/1929 | Sowden | 53/227 |
| 1,934,756 | 11/1933 | Smith | 53/226 X |
| 2,851,835 | 9/1958 | Collins | 53/464 X |
| 2,915,861 | 12/1959 | Voullaire | 53/464 |
| 3,106,050 | 10/1963 | Westphal | 53/226 |
| 3,245,198 | 4/1966 | Schmeid | 53/464 |

FOREIGN PATENT DOCUMENTS

| | | | |
|---|---|---|---|
| 710500 | 6/1954 | United Kingdom | 53/226 |

*Primary Examiner*—John Sipos

*Attorney, Agent, or Firm*—Poms, Smith, Lande & Rose

[57] ABSTRACT

A system for wrapping and sealing objects, such as fresh heads of lettuce, may include two fabric tube type iris valves which are capable of fully closing and opening up to a diameter greater than the object to be wrapped and sealed. The two iris valves may be mounted one above the other; then a sheet of plastic wrap film material is dispensed over the top iris valve, and a head of lettuce is set in place on the sheet of plastic. The sheet of plastic may be dispensed from a roll automatically and may be cut either mechanically or by a hot wire, for example. The upper iris valve is open end, and then, as the head of lettuce or other object slides through and is supported by the lower iris valve, the upper valve is at least substantially closed, rotating and drawing together the edges of the plastic wrap. The plastic sheet material is then heat sealed above the head of lettuce, either above or below the upper iris valve. In one embodiment a carousel arrangement is provided wherein the heads of lettuce are loaded at one station, and wrapped at another.

18 Claims, 10 Drawing Figures

WRAPPING AND SEALING APPARATUS

FIELD OF THE INVENTION

This invention relates to systems for wrapping and sealing objects, such as fresh produce.

BACKGROUND OF THE INVENTION

In the harvesting of certain produce, such as fresh heads of lettuce, it is desirable to wrap and seal the heads of lettuce in the field, in order to preserve them and to avoid deterioration as they are handled and shipped to market. As of the present time, this wrapping and sealing is done mostly by hand, with efforts at automation up to the present time having been sporadic and ineffective.

Accordingly, a principal object of the present invention is to simplify and automate the wrapping and sealing of fresh lettuce heads, other produce, and even other objects.

In accordance with one important aspect of the present invention, it has been determined that a certain type of valve, known as an iris valve, and which is normally used for the flow control of grain and the like, is particularly well suited for inclusion in systems for wrapping and sealing objects, such as fresh heads of lettuce. These iris valves involve the use of two open circular members which are mounted adjacent one another, and which have a tube of cloth or other fabric material with one end of the tube being secured to each of the two open circular members. When the two discs are aligned so that the cloth tube is not twisted, it is open and hangs down as a double cylinder from the two open circular members. These two circular members are mounted for rotation relative to one another, and as one of them is rotated relative to the other, the tube is gradually twisted and closed until it is finally closed completed. In this way, when the iris valve is used to control the flow of wheat or other granular material, for example, the flow may be gradually shut off as one of the two open circular members is rotated relative to the other.

The discs come in various sizes up to 12 inches or so in diameter, and a head of lettuce or other similar sized object will easily fit through the iris valve when it is opened, and be supported by it when it is closed or substantially closed.

In accordance with an important aspect of the present invention, an iris valve of the type described above, including a fabric tube, is employed in the wrapping and sealing of heads of lettuce or the like by initially dispensing a sheet of thin plastic wrapping material across the upper surface of the iris valve, and then placing the object to be wrapped on top of the valve, with the plastic layer underneath, between the object and the valve. The valve is then slowly opened so that the object slides down through the valve and engages a support (which may be another iris valve) and the upper iris valve is then drawn closed to pull the plastic sheet material over the upper surface of the object to be wrapped. The fabric tube also rotates as it is closing, thus assisting in wrapping the plastic film around the object. The plastic material is then sealed, preferably with a heat sealing member, either above the iris valve where the plastic sheet material has been drawn together, or immediately below the surface of the iris valve.

Additional features of the invention include the following:

(1) The use of multiple stations either movable or stationary, so that the object may be loaded at one station, and wrapping and sealing occurs at another station.

(2) The use of a rotating carousel unit having multiple stations to implement the wrapping and sealing function, while not slowing down the loading and depositing function which may be accomplished by the worker at his own pace.

(3) The use of automatic controls for opening and closing the iris valve or valves.

(4) The use of conveyor belts to facilitate carrying the wrapped objects away from the wrapping and sealing station and to a packaging location.

(5) The use of automatically actuated plastic sheet cutting arrangement, either of the mechanical cutting or of the hot wire type.

(6) The use of automatically actuated heat sealing arrangements, either by a hydraulic cylinder operating a heated element onto the upper surface of the plastic material above the upper valve, or by mating V-shaped sealing elements moving inwardly below the upper iris valve.

(7) The use of the second iris valve for controllably releasing the object into a conveyor belt or other receptacle following completion of the wrapping and sealing operation.

(8) The multi-station carousel type arrangement may include a series of iris valves mounted at an angle relative to the horizontal, to facilitate loading the heads of lettuce or other produce at one side, and providing sufficient elevation on the other side to accommodate a pair of overlying iris valves at the wrapping and sealing station, with space for a conveyor belt or other receptacles below the wrapping and sealing station.

Other objects, features and advantages of the present invention will become apparent from a consideration of the following detailed description and from the accompanying drawings.

DETAILED DESCRIPTION

Figure 1:
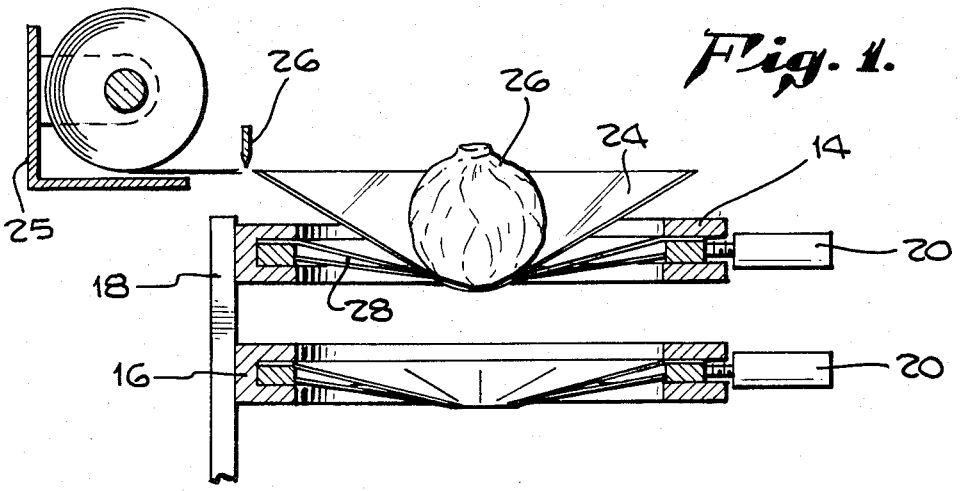
FIG. 1 shows a simple manually operable wrapping and sealing station including two fabric tube type iris valves.

Referring more particularly to the drawings, FIG. 1 shows an assembly of two fabric tube type iris valves 14 and 16 mounted one above the other. Each of the two iris valves 14 and 16 includes a pair of open rings, with a cylindrical tube of fabric having one end peripherally secured to one of the two relatively rotatable rings, and the other end of the tube secured to the other relative movable rings. Each one of the valves 14 and 16 is a commercially available unit which may be purchased as a "SYNTRON" iris flow control valve, from FMC Corporation, material Handling Equipment Division, Homer City, PA, 15748.

With one of the two open circular elements of each of the valves 14 and 16 being secured to the mounting frame 18, the individual valves may be opened or closed by the rotation of the handle 20 associated with the valve 14 and by a similar handle for the lower valve 16. A supply of thin transparent plastic sheet material 24 is provided, and it may be dispensed from any suitable dispenser or holder 25 and cut off by a cutting edge 26 or a hot wire which is maintained at a temperature above the melting point of the plastic sheet material 24. As shown in FIG. 1, a sheet 24 of the plastic film material has been laid across the upper surface of the valve 14, and a head of lettuce 26 placed on top of the film at the center of the iris valve 14. Further, the iris valve 14 has been partially opened to permit the head of lettuce 26 to drop down into the valve 14 to some extent.

Figure 2:
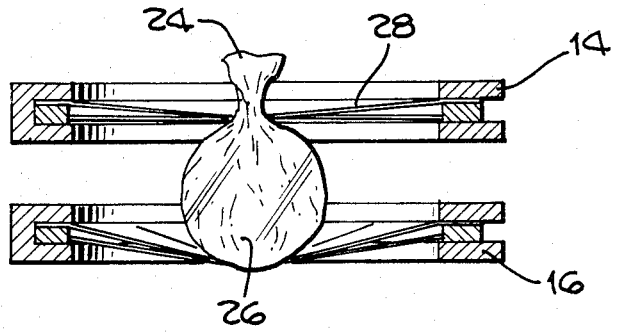
FIG. 2 shows the next step in the wrapping and sealing process, in which the upper iris valve has been opened and the plastic film material wrapped around its side surfaces.

As shown in FIG. 2, the head of lettuce 26 has been permitted to drop down by further opening of valve 14 and is supported by the lower valve 16 which is in its substantially closed or only partially open state. The upper valve 14 has been partially closed following the lowering of the head of lettuce 26 down to the lower valve 16. This partial closure action causes a rotation of the fabric tube and draws the plastic film material around, up and over the top of the head of lettuce 26.

Figure 3:
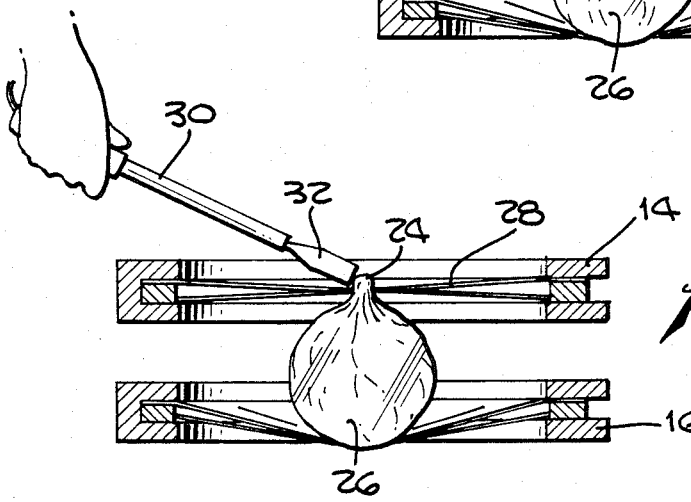
FIG. 3 represents the third step wherein the upper iris valve is substantially closed, drawing the plastic wrapping material entirely over the surface of the object to be wrapped, and the edges of the plastic sheet material are heat sealed together above the upper iris valve.

The next step is shown in FIG. 3, where only the upper edges of the plastic material 24 are visible as the fabric sleeve 28 forming a part of the upper valve 14 is closed almost to its full shutoff position. The heat sealing implement 30 has its working end 32 heated to a temperature above the melting point of the plastic film 24, and engaging the head 32 with the plastic 24 serves to complete the sealing step.

Incidentally, the fabric 28 included in the upper valve 14, may be of TEFLON, fine metal mesh, or other high temperature resistant material so that it is not injured or melted by the heat sealing head 32.

Figure 4:
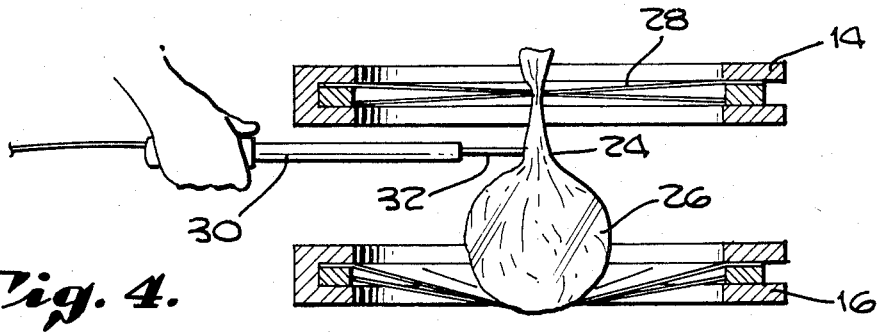
FIG. 4 shows the possibility of alternate or supplemental heat sealing along the upper surface of the object to be wrapped and sealed, immediately under the upper iris valve.

Instead of heat sealing from above, as shown in FIG. 3, once the head of lettuce or other object has been wrapped, it may be heat sealed around its upper surface where the plastic material 24 has been drawn together, immediately under the upper valve 14, as shown in FIG. 4. For heat sealing at this location, the spacing between the two valves is preferably increased somewhat over that required for heat sealing as shown in FIG. 3.

Figure 5:
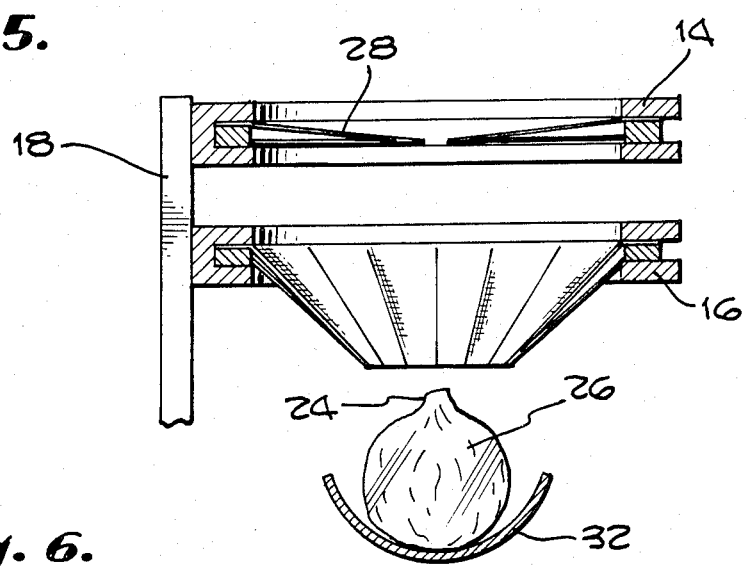
FIG. 5 shows the final step in the process, with the lower iris valve being opened to deposit the wrapped and sealed object in a receptacle.

FIG. 5 shows the next step, by which the lower iris valve 16 is opened, and the wrapped head of lettuce 26, or other wrapped object, is placed on a conveyor belt 32, or other receptacle employed to receive successive wrapped objects.

The wrapping and sealing method has been described hereinabove in connection with arrangements including two of the iris valves 14 and 16. However, instead of using the lower valve 16, a simple movable receptacle or support member could be employed, with gravity release arrangements for permitting the receptacle or support to tilt downward and dump the wrapped object onto the conveyor belt once the receptacle is released following the heat sealing step. This might be advantageous in certain applications, where the relatively high cost of the second valve 16 is an important factor.

Figure 6:
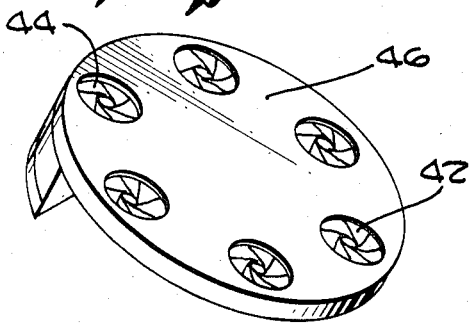
FIG. 6 is a diagrammatic showing of a multi-station sealing and packaging system employing a rotating carousel table with a plurality of iris-type valves mounted on its upper surface.
Figure 7:
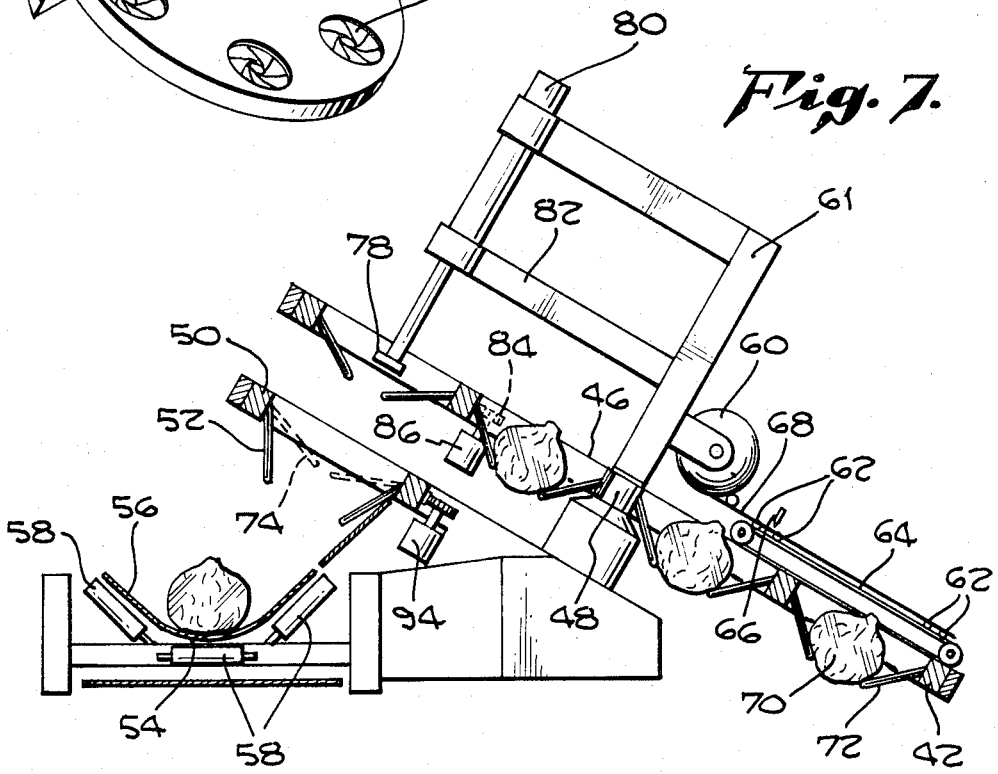
FIG. 7 is a more detailed cross-sectional view indicating the mode of operation of the system shown diagrammatically in FIG. 6.

Referring now to FIG. 7, it is a schematic cross-sectional view of a carousel or multi-station indexing table 46 of the type generally shown in FIG. 6. In FIG. 7, the two diametrically opposed iris valves 42 and 44 are located at the loading station on the right-hand side of FIG. 7 and at the wrapping and sealing station at the left-hand side of FIG. 7. The table or carousel member 46 is movable and rotates about the bearing 48, and the remainder of the structure as shown in FIG. 7 is fixed or does not rotate with the table 46. Below the iris valve 44, as shown at the wrapping and sealing station, is the second iris valve 50. As shown by the lower position of the cloth tube element 52, the iris valve 50 is open, and the wrapped head of lettuce 54 has been released to move onto the conveyor belt 56, mounted on rollers 58 or other conveying devices to convey the lettuce to a packing point.

The roll of transparent plastic film 60 is mounted on the central stationary support column 61. The film 68 from roll 60 is advanced across the particular iris valve, such as iris valve 42, at the loading station, by the rods 62 extending across between the two endless belts 64 which are periodically advanced to move the film across the iris valve 42, and the other iris valves on the carousel, as they are advanced to the loading station. The hot wire 66 moves across the film 68, and cuts off a sheet of film adequate to wrap the head of lettuce 70. With six stations on the carousel or index table 46, flexibility is given to the field hand who cuts the heads of lettuce and places them on the loading station. More specifically, in the event there is no unloaded iris valve and additional heads have been picked, instead of waiting for rotation of the carousel or index table, the heads of lettuce may be placed on empty iris valves which have moved to stations between the normal loading station, and the wrapping and sealing station. In these additional locations, a sheet of plastic will have been located across the iris valve, but no head of lettuce will have been placed on it. Accordingly, some flexibility between the loading and the regularly timed advance of the index table is provided.

Now, considering the mode of operation of the system shown in FIG. 7, it is quite similar in operation to the simpler single station arrangement as described hereinabove in connection with FIGS. 1 through 5 of the drawings. More specifically, the iris valve 42 is initially in the fairly closed position, with the cloth tube 72 defining an opening of perhaps 2 or 3 inches, so that the head of lettuce 70 or other object will not fall through. This condition of the iris valve is maintained until the index table or carousel is rotated to the wrapping and sealing station as indicated at iris valve 44 in FIG. 7. At this location, the lower iris valve 50 is initially in the moderately closed position as indicated by the dashed lines 74 and the cloth tube 76 associated with the upper iris valve 44 is open so that the head of lettuce drops down and is supported by the lower iris valve 50. This iris valve 44 is then partially closed, to draw the plastic sheet material up over the top of the head of lettuce, in a manner similar to the showing of FIG. 3 of the present drawing. The heat sealing element 78 is then advanced by the hydraulic cylinder 80, with guidance being provided by the bracket 82.

Figure 8:
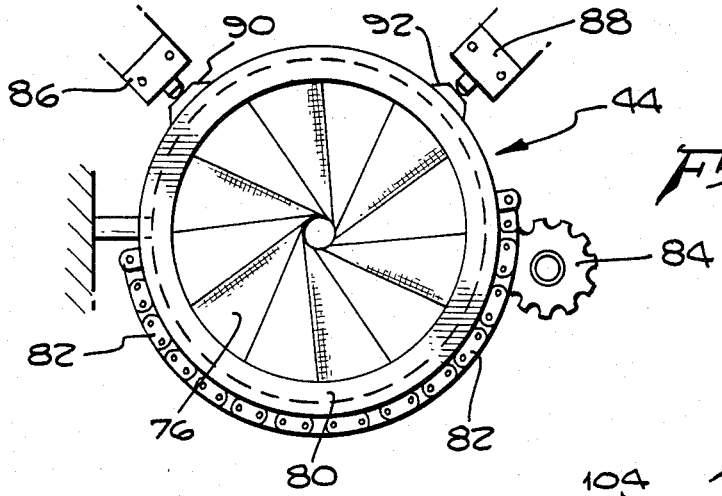
FIG. 8 is a detailed showing of one mode of automatic actuation for the iris valves of the system of FIG. 7.

The iris valves 42 and 44 are preferably controlled hydraulically, although other control techniques may be employed. Specifically, one of the two peripheral circular members of each of valves 42 and 44 is secured to the index table or carousel 46, and the other is rotated in a controlled manner. FIG. 8 shows one arrangement for accomplishing this type of control. More specifically, in FIG. 8 the iris valve 44 has its lower open cylindrical member fixed and the upper member 80 has a sprocket chain 82 secured to it. A sprocket 84 is driven by a hydraulic motor 86 (see FIG. 7) and limit valves such as valves 86 and 88 which are controlled by cams 90 and 92, respectively, serve to determine the angular rotation of ring 80 as caused by the hydraulic motor 86 which rotates the sprocket 84. These valves 86 and 88 turn off the hydraulic motor when the ring 80 reaches the desired angular orientation in the course of the cycle. In this way, the degree of opening or closure of the cloth tube 76 is established. In a similar manner, the opening and closing of the valve 50 may be accomplished through the hydraulic motor 94 (see FIG. 7).

Concerning the cutoff of the plastic sheet material 68, by the hot wire 66, this may be accomplished by the placing of the head of lettuce on the plastic film, and depressing the plastic sheet material from the supporting rods 62 into engagement with the hot wire 66. Alternatively, the hot wire may be raised and lowered hydraulically by mounting it on a suitable reciprocating element, and successive sheets of plastic material may be cut off by first raising the wire on one cycle and then lowering it through the sheet material on the next cycle.

Figure 9:
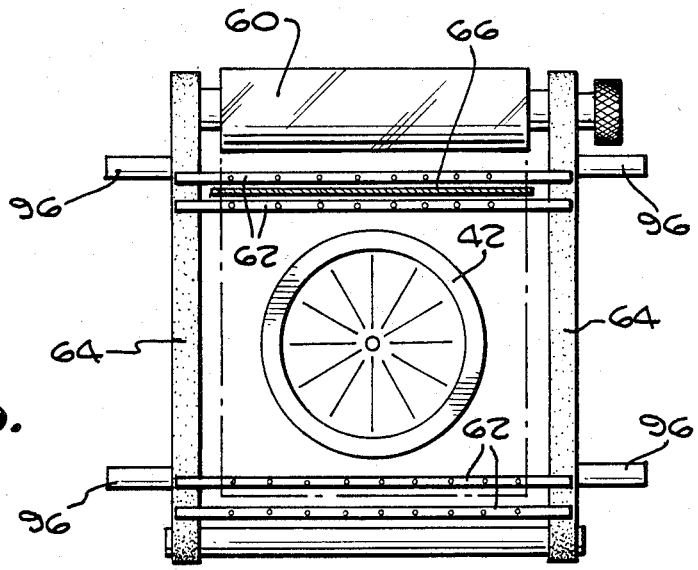
FIG. 9 is a top view looking down at an automatic loading station and indicating the mode of operation of the plastic film advancing and cutting arrangements.

FIG. 9 is a fragmentary a schematic top view of the loading station, indicating the roll of plastic film 60, the iris valve 42, the pairs of suction rods or tubes 62 carried by the belts 64 (three or more pairs being provided, with two pairs handling the film as it is advanced) and the hot wire 66. The roll of film is normally advanced by the automatic rotation of the belt 64; however, emergency handles 96 may be provided to permit manual advancing of the plastic film, if desired or necessary. The rods or tubes 64 are preferably apertured and reduced pressure or suction may be used to more positively hold the plastic film.

Figure 10:
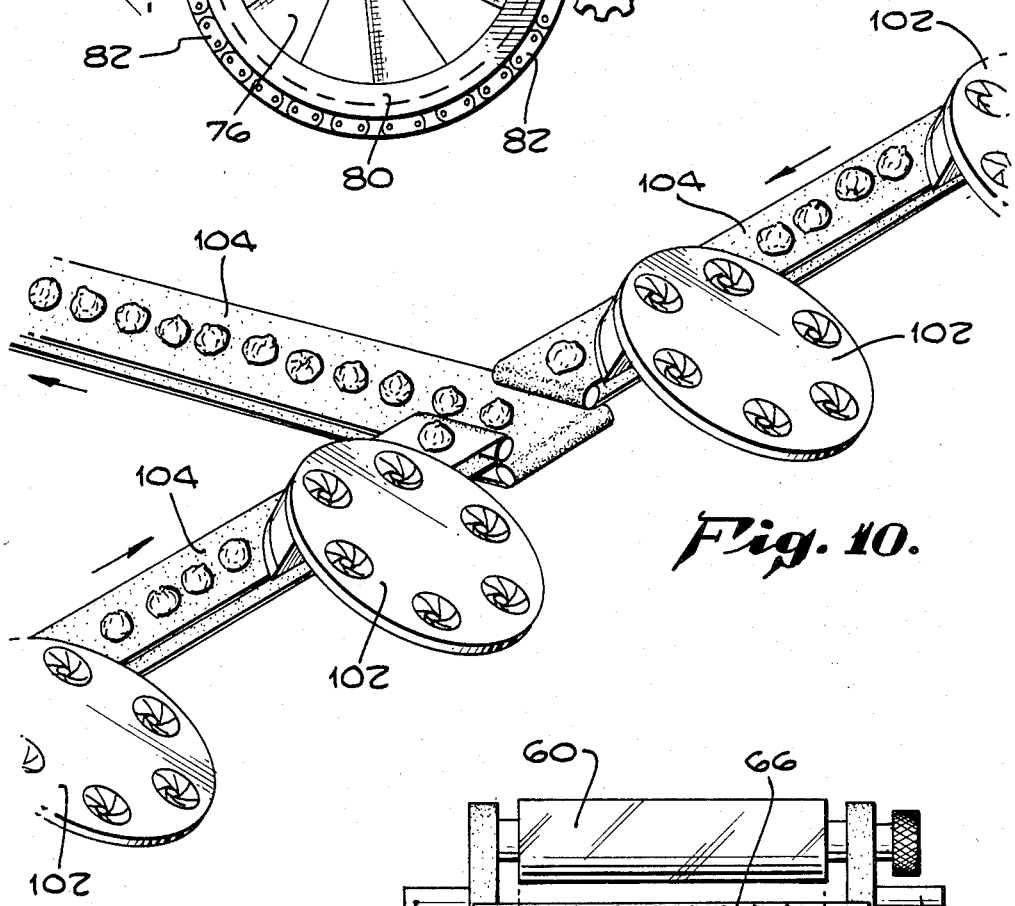
FIG. 10 shows schematically a system employing multiple carousels and an output conveyor arrangement.

FIG. 10 is a schematic showing of a packaging system including six packaging carousels 102 (only two of which are shown in FIG. 10), each corresponding generally to that shown in FIG. 7 of the drawings. In addition, suitable conveyor arrangements 104 may be provided to bring the wrapped and sealed heads of letture or other objects to a single point where they may be placed in a box or other larger shipping container ready for transportation to market. The conveyors 104 may be dished or provided with side rails to retain the objects being transported; and may be either gravity powered, in which case they would have a slight downslope; or they could be powered in any desired manner, preferably hydraulically from the same source of power as is supplied to the carousels or index tables and the associated automatic actuation arrangements for the valves and hydraulic cylinders.

Incidentally, with regard to fixed station arrangements such as those shown in FIGS. 1 through 5 of the drawings, automated plastic film feeding, cut-off, and sealing arrangements such as those shown in FIG. 7 may be provided. However, with regard to heat sealing, instead of an overhead hydraulic unit of the type shown in FIG. 7 at 78 and 80, it is preferable to seal immediately below the upper valve, in the location indicated in FIG. 4 of the drawings when a fixed station unit is used. In an automated arrangement, this may be accomplished by two opposed V-shaped heated elements which would extend inwardly from opposite sides of the valve, and immediately below it, so that sealing would be accomplished without undue interference with the space above the valve, which might otherwise interfere with loading.

The tube type iris valves come in standard size from 4" to 12" openings, and for the packaging of lettuce heads, the 10" size is adequate. The outer diameter of these 10" units is approximately 13½ inches, and for the arrangement of FIGS. 1–5, a spacing of approximately 3 inches between the upper and lower units has proven satisfactory. Of course, with different size objects to be wrapped and sealed different dimensions would be selected.

It is to be understood that the foregoing detailed description and the accompanying drawings are illustrative of preferred embodiments of the invention; however, other changes and alternatives may be employed in place of particular arrangements as shown and described hereinabove. Thus, by way of example, and not of limitation, instead of the lower iris valve, some other receptacle could be employed which might tilt or be otherwise movable to shift the wrapped and sealed object such as the head of lettuce to a packaging point. Similarly, a mechanical cutting arrangement could be employed in place of the hot wire 66 disclosed in connection with FIG. 7 of the drawings. Also, the carousel or index wheel may be rotated by any suitable arrangement, such as a Geneva wheel mechanism, or other suitable known form of arrangement for moving an index table by a desired angular increment. In addition, each station of the carousel may be provided with two spaced overlying iris valves, as shown in FIGS. 1 through 5, and successive steps accomplished at the various stations, as the carousel is stepped around. Accordingly, the present invention is not limited to that precisely shown and described hereinabove.

What is claimed is:

1. A system for wrapping and sealing objects, such as fresh lettuce heads, comprising:

first and second fabric tube type iris valves each having a diameter greater than the object to be wrapped and sealed, said fabric tube type iris valves each including a pair of open circular frame members to which the ends of a fabric tube are secured, with the frame members being rotatable with respect to one another to open and close the iris valve;

means for mounting said two iris valves one above the other and spaced apart by a distance in the order of the size of the object to be wrapped and sealed;

means for dispensing thin plastic film wrapping material from a roll across the top of the upper iris valve;

means for cutting off a sheet of said plastic film material with said sheet extending over said upper valve;

means for opening the upper valve following the placement of the object on said plastic film sheet so that said object and film are supported by the closed upper valve to permit the object to be supported by the lower iris valve, and for at least partially closing said upper valve to draw the plastic sheet material together and around the object to be wrapped and sealed;

means for heat sealing the plastic sheet material over the object being wrapped; and means for opening the lower valve to release or dispense the wrapped and sealed object;

whereby fragile articles to be wrapped are supported and cushioned by the fabric of the fabric tube type iris valves, and the rotary closing motion of the upper fabric valve automatically twists the plastic film as the object is being wrapped.

2. A wrapping and sealing system as defined in claim 1 wherein said iris valves are at least eight inches in inner open diameter.

3. A wrapping and sealing system as defined in claim 1, wherein said cutting means is a hot wire heated to a temperature above the melting point of said plastic sheet material.

4. A wrapping and sealing system as defined in claim 1 wherein said cutting means includes a blade.

5. A wrapping and sealing system as defined in claim 1 further comprising at least one additional fabric tube type iris valve means for receiving objects to be wrapped and sealed, and means for shifting said additional iris valve to a location over said lower iris valve where the wrapping and sealing takes place.

6. A wrapping and sealing system as defined in claim 5 wherein said system includes a carousel or index table and wherein said first iris valve and said additional iris valves are mounted on said carousel or index table.

7. A wrapping and sealing system as defined in claim 1 further including conveyor belt means for receiving said wrapped and sealed objects, following opening of said lower iris valve.

8. A system for wrapping and sealing objects, comprising:

a fabric tube type receiving iris valve having a diameter greater than the object to be wrapped and sealed;

said fabric tube type iris valve including a pair of open circular frame members to which the ends of a fabric tube are secured, with the frame members being rotatable with respect to one-another to open and close the iris valve;

means for supporting the object to be wrapped and sealed;

means for mounting said iris valve above said supporting means and spaced therefrom by a distance in the order of the size of the object to be wrapped and sealed;

means for dispensing a sheet of thin plastic wrapping material across the top of said iris valve;

means for opening said iris valve following the placement of the object on the wrapping material so that said object and material are supported by the closed valve to permit the object to be supported by said supporting means, and for at least partially closing said iris valve to draw the plastic sheet material together and around the object to be wrapped and sealed; and means for securing the plastic sheet material over the object being wrapped;

whereby fragile articles to be wrapped are supported and cushioned by the fabric of the fabric tube type iris valve, and the rotary closing motion of the fabric valve automatically twists the plastic film as the object is being wrapped.

9. A system for wrapping and sealing objects as defined in claim 8 wherein said system includes means for moving said object away from its supported location immediately under said receiving iris valve.

10. A system for wrapping and sealing objects as defined in claim 8 wherein said supporting means is a second iris valve.

11. A system for wrapping and sealing objects as defined in claim 8 wherein said iris valve has a central opening when in the open state of at least six inches.

12. A wrapping and sealing system as defined in claim 8, wherein said cutting means is a hot wire heated to a temperature above the melting point of said plastic sheet material.

13. A wrapping and sealing system as defined in claim 8 wherein said cutting means includes a blade.

14. A wrapping and sealing system as defined in claim 8 further comprising at least one additional fabric tube type iris valve means for receiving objects to be wrapped and sealed, and means for shifting said additional iris valve to a location over said supporting means where the wrapping and sealing takes place.

15. A wrapping and sealing system as defined in claim 14 wherein said system includes a carousel or index table and wherein said first iris valve and said additional iris valves are mounted on said carousel or index table.

16. A wrapping and sealing system as defined in claim 8 further including conveyor belt means for receiving said wrapped and sealed objects from said supporting means.

17. A method for wrapping and sealing objects, such as fresh lettuce heads, comprising the steps of:

dispensing a sheet of thin plastic film wrapping material across the top of a fabric tube type receiving iris valve;

said fabric tube type iris valve including a pair of open circular frame members to which the ends of a fabric tube are secured, with the frame members being rotatable with respect to one-another to open and close the iris valve;

placing the object to be wrapped and sealed on the sheet of plastic film so that said object and film are supported by the closed iris valve;

opening the iris valve following the placement of the object on said valve;

supporting the object so that its top surface is just below the iris valve;

at least partially closing the iris valve to draw the plastic sheet material together and around the object to be wrapped and sealed;

heat sealing the plastic sheet material over the object being wrapped; and shifting the wrapped and sealed object away from its location immediately below the iris valve to permit the wrapping and sealing of the next object;

whereby fragile articles to be wrapped are supported and cushioned by the fabric of the fabric tube type iris valve, and the rotary closing motion of the fabric valve automatically twists the plastic film as the object is being wrapped.

18. A method as set forth in claim 17 wherein said supporting step is implemented by the substantial closing of a second fabric tube type iris valve mounted below the receiving iris valve, and said shifting step is accomplished by opening said second iris valve.

* * * * *